US010190477B2

(12) United States Patent
Yang et al.

(10) Patent No.: US 10,190,477 B2
(45) Date of Patent: Jan. 29, 2019

(54) SPLIT COOLING SYSTEM OF INTERNAL COMBUSION ENGINE

(71) Applicant: Hyundai Motor Company, Seoul (KR)

(72) Inventors: Kwang Sik Yang, Gunpo-si (KR); Jun Sik Park, Seoul (KR); Bong Hoon Han, Seoul (KR)

(73) Assignee: Hyundai Motor Company, Seoul (KR)

( * ) Notice: Subject to any disclaimer, the term of this patent is extended or adjusted under 35 U.S.C. 154(b) by 9 days.

(21) Appl. No.: 15/365,857

(22) Filed: Nov. 30, 2016

(65) Prior Publication Data

US 2017/0370275 A1 Dec. 28, 2017

(30) Foreign Application Priority Data

Jun. 22, 2016 (KR) ..... 10-2016-0077685

(51) Int. Cl.

| | |
|---|---|
| ***F01P 3/00*** | (2006.01) |
| ***F01P 7/16*** | (2006.01) |
| ***F01P 3/02*** | (2006.01) |
| ***F01P 5/10*** | (2006.01) |
| ***F01P 11/08*** | (2006.01) |
| *F01P 7/14* | (2006.01) |

(52) U.S. Cl.

CPC *F01P 7/16* (2013.01); *F01P 3/02* (2013.01); *F01P 5/10* (2013.01); *F01P 11/08* (2013.01); *F01P 2003/027* (2013.01); *F01P 2007/146* (2013.01)

(58) Field of Classification Search

CPC ..... F01P 2060/02; F01P 2060/08; F01P 2060/16; F01P 3/20; F01P 7/165; F01P 11/08; F01P 2003/027; F01P 2007/146; F01P 3/02; F01P 5/10; F01P 7/16; F02F 1/26; F02F 1/36; F02M 25/0738; F02M 26/28

USPC ..... 123/41.01, 41.02, 41.08, 41.09, 41.17, 123/41.31, 41.44, 196 AB

See application file for complete search history.

(56) References Cited

U.S. PATENT DOCUMENTS 4,548,183 A 10/1985 Hayashi
6,581,550 B2 * 6/2003 Shinpo ..... F01P 3/02 123/41.74

(Continued)

FOREIGN PATENT DOCUMENTS

JP 2003-293767 A 10/2003
JP 2012-172525 A 9/2012

(Continued)

*Primary Examiner* — Marguerite McMahon
*Assistant Examiner* — Tea Holbrook
(74) *Attorney, Agent, or Firm* — Morgan, Lewis & Bockius LLP

(57) ABSTRACT

A split cooling system of an internal combustion engine may include a water pump configured to circulate cooling water; a cylinder head and a cylinder block configured to be supplied with the cooling water from the water pump; an integrated flow control valve configured to include an inlet provided to be supplied with the cooling water of the cylinder head and a plurality of valves that are configured to be opened or closed to distribute the cooling water introduced through the inlet to an oil heat exchanger, a heater core, and a radiator; and a split cooler configured to be mounted at the cylinder block to provide a split cooling channel in the cylinder block and the cylinder header.

8 Claims, 5 Drawing Sheets

(56) References Cited

U.S. PATENT DOCUMENTS 6,834,625 B2 * 12/2004 Matsutani ..... F01P 3/02 123/41.72
6,874,451 B2 * 4/2005 Matsutani ..... F01P 3/02 123/41.79
7,798,108 B2 * 9/2010 Konishi ..... F02F 1/36 123/41.72
9,032,916 B2 * 5/2015 Nishio ..... F02F 1/10 123/41.72
2003/0230253 A1 * 12/2003 Matsutani ..... F01P 3/02 123/41.74
2005/0034688 A1 * 2/2005 Lelkes ..... F01P 7/167 123/41.01
2009/0194046 A1 * 8/2009 Shikida ..... F02F 1/14 123/41.74
2009/0308335 A1 * 12/2009 Dipaola ..... F01P 7/165 123/41.1
2010/0242868 A1 * 9/2010 Shikida ..... F01P 3/02 123/41.79
2016/0010533 A1 * 1/2016 Matsumoto ..... F01P 3/02 123/41.08
2016/0084143 A1 * 3/2016 Lee ..... F01P 7/165 123/41.08
2016/0376977 A1 * 12/2016 Watanabe ..... F01P 5/12 123/41.08
2017/0030251 A1 * 2/2017 Watanabe ..... F02D 41/04
2017/0306833 A1 * 10/2017 Yang ..... F01P 3/02
2017/0342939 A1 * 11/2017 Araki ..... F02F 1/14
2017/0350302 A1 * 12/2017 Araki ..... F02F 1/14

FOREIGN PATENT DOCUMENTS

KR 10-1998-0046112 A 9/1998
KR 10-2004-0092506 A 11/2004
KR 10-1558394 B1 10/2015

* cited by examiner

SPLIT COOLING SYSTEM OF INTERNAL COMBUSION ENGINE

CROSS REFERENCE TO RELATED APPLICATION

The present application claims priority to Korean Patent Application No. 10-2016-0077685, filed on Jun. 22, 2016, the entire contents of which is incorporated herein for all purposes by this reference.

BACKGROUND OF THE INVENTION

Field of the Invention

The present invention relates to a cooling system of an internal combustion engine, and more particularly, to a split cooling system of an internal combustion engine including a split cooler for splitting a flow of cooling water within a water jacket of a cylinder block to improve cooling efficiency of the internal combustion engine to thereby remove a separate split cooling valve.

Description of Related Art

Generally, car makers have made an effort to achieve improvement in fuel efficiency and reduction in emission during the development of cars. Among those, to meet emission regulations, a method for increasing a catalyst loading amount of an exhaust system or increasing a capacity of an exhaust gas recirculation (EGR) cooler notwithstanding that manufacturing costs and a weight of a car are greatly increased has been applied.

Generally, to prevent an engine from overheating and appropriately keep a temperature of the engine, a method for forming a cooling channel in a cylinder block and a cylinder head of the engine and forcibly circulating cooling water to the cooling channel by an operation of a water pump has been used.

In particular, a thermostat or a separate flow control valve is mounted to perform split cooling of an engine head and an engine block and an integrated flow control valve is mounted at a final outlet of the cooling water of the engine to optimally control a flow rate of the cooling water flowing in a radiator, a heater core, an oil cooler, and an EGR cooler.

In this case, the integrated flow control valve is a single component based on a 4-way control scheme that integrally controls the flow rate of the cooling water flowing in the radiator, the heater core, the oil cooler, and the EGR cooler. By doing so, the flow rate of the cooling water flowing in the four components is shut off or opened cross sectional areas of a channel toward the four components are relatively changed, in response to the temperature of the cooling water flowing in the engine head or the engine block, thereby optimally distributing the flow rate of the cooling water.

However, the problem in that a cost burden of the integrated flow control valve based on the 4-way control scheme and the thermostat is increased and a layout is complicated may be caused. Further, the cooling water that is an object to be controlled is only the cooling water passing through the engine, and therefore the temperature of the cooling water flowing in the EGR cooler and the oil cooler is relatively increased, such that cooling performance of the coolers may deteriorate.

FIGS. FIG. 6, FIG. 7, and FIG. 8 are graphs illustrating the existing behavior of the engine and illustrate a change in a vehicle speed and an engine load.

TABLE 1

| | REG. 1 | REG.2 | REG.3 | REG.4 | REG.5 |
|---|---|---|---|---|---|
| Driving feature | IDLE/ Low-load operation | Mid-load operation | Mid-load operation | High load/Hill climbing operation | Mid-load operation |
| Cooling water feature | Stop flow | Warm-up | Keep temperature | Increase in limit temperature | Keep temperature |
| Heater side cooling water | Necessary (Upon heating) | Necessary (Upon heating) | Unnecessary | Unnecessary | Unnecessary |
| Oil side cooling water | Unnecessary | Necessary | Necessary | Necessary | Unnecessary |

If it is confirmed whether a heat exchange between heater side cooling water (heating condition) and oil side cooling water needs to be performed depending on each range, it can be appreciated from the above Table 1 that they conflict with each other except for the case of the range 2. Therefore, the channels for the cooling water for heating and the oil cooling water need to be split.

FIG. 7 is a graph illustrating a torque value depending on an engine RPM and FIG. 8 is a graph illustrating a graph depending on a valve position and a valve opening. To control the temperature of the cooling water, an opening needs to be positioned around region A or B in which a radiator opening is controlled. However, when a sudden acceleration/deceleration are repeated upon a driving of a vehicle, as a load condition of the engine, A and B conditions are repeated. In this case, a split cooling port is repeatedly opened and closed by split cooling operation mapping. In this case, to control the temperature of the cooling water, the port needs to reciprocate the A and B. However, the temperature control of the cooling water is instable due to a difference in flow rate distribution of cooling water in the respective portions under the A and B conditions, a cooling water control delay due to a difference in time when the B is repeatedly operated at the A, and a difference in flow rate distribution of cooling water while the B is repeatedly operated at the A.

Therefore, for the integrated flow control valve to implement variable split cooling, a 4-port specification needs to be applied but when the integrated flow control valve is restricted in a size to be mounted in the engine, there is a case in which a 3-port variable control specification needs to be applied. In this case, a variable control port is generally bound with a radiator control, a block flow rate control for split cooling, an oil system+heating system flow rate control but when the oil and heating control are bound into one, there is a problem in that the effective heat management may not be performed.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a split cooling system of an internal combustion engine configured for effectively performing heat management using an integrated flow control valve by splitting a heating channel and an oil channel and solving control instability of the temperature of the cooling water occurring at the time of applying variable split cooling by removing a variable split cooling port and implementing mechanical split cooling.

According to an exemplary embodiment of the present invention, there is provided a split cooling system of an internal combustion engine, including: a water pump configured to circulate cooling water; a cylinder head and a cylinder block configured to be supplied with the cooling water from the water pump; an integrated flow control valve configured to include an inlet provided to be supplied with the cooling water of the cylinder head and a plurality of valves that are opened and closed to distribute the cooling water introduced through the inlet to an oil heat exchanger, a heater core, and a radiator; and a split cooler configured to be mounted at the cylinder block to provide a split cooling channel in the cylinder block and the cylinder header.

The split cooler may be inserted into a water jacket of the cylinder block and may include: a base configured to enclose an outside of the cylinder along a shape of a cylinder; a coupling groove formed to be indented into an inside surface of the base; and a sealing member configured to be filled in the coupling groove and expanded when the temperature of the cooling water supplied into the water jacket is equal to or higher than a preset temperature to cut off a channel between the base and the cylinder, to thereby increase a flow resistance of the cooling water and reduce a heat transfer rate, thereby performing the split cooling.

The base may be formed from a lower side of the cylinder block to a ⅔ point of a height of the cylinder block.

The coupling groove may be formed along a horizontal direction of the base and may be formed in a closed curve.

The sealing member may be EPDM rubber and may be foamed and then compressed to be foamed when the cooling water is equal to or more than the predetermined temperature.

Siamese parts of the base may be provided with a plurality of guide members.

The cylinder block may include a moving channel through which the cooling water of the cylinder block moves to the cylinder head and the cooling water of the cylinder block may move to the cylinder head and then may be supplied to the integrated flow control valve together with the cooling water of the cylinder head.

The integrated flow control valve may include at least one motor to control an opening and closing of a first valve, a second valve, and a third valve.

The plurality of valves of the integrated flow control valve may include a first valve provided to supply the cooling water to the oil heat exchanger, a second valve provided to supply the cooling water to the heater core, and a third valve provided to supply the cooling water to the radiator.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
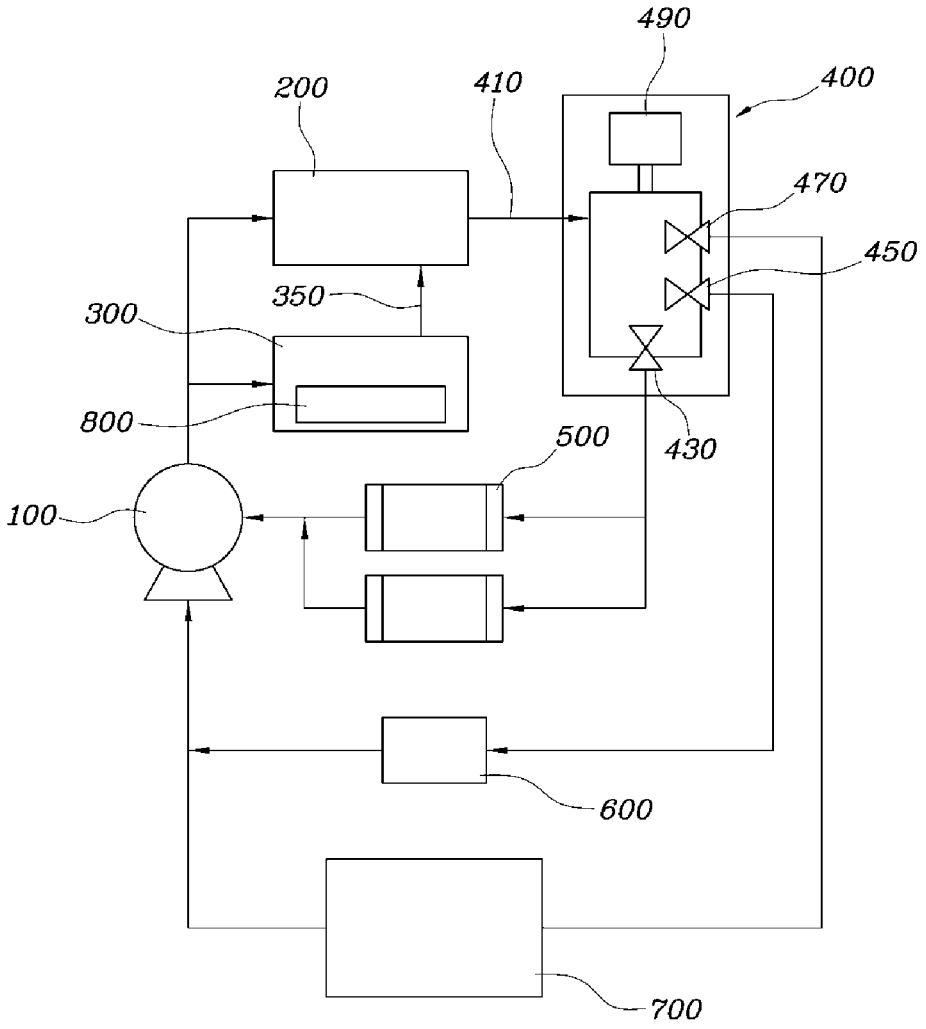
FIG. 1 is a view illustrating a split cooling system of an internal combustion engine according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, a split cooling system of an internal combustion engine according to an exemplary embodiment of the present invention will be described with reference to the accompanying drawings.

Figure 2:
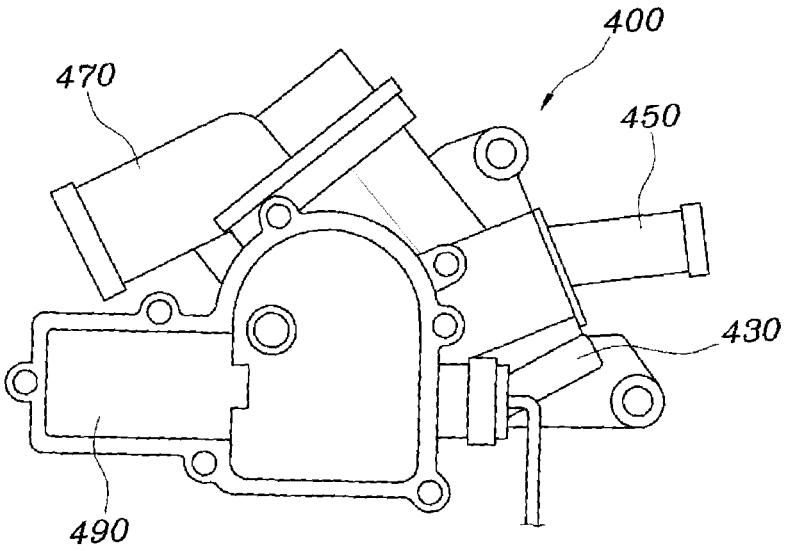
FIG. 2 is a view illustrating an integrated flow control valve of FIG. 1.
Figure 3:
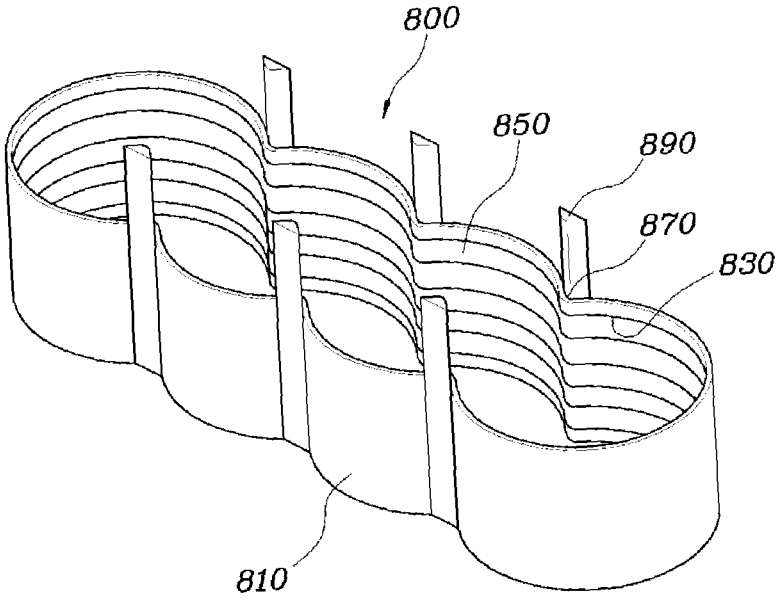
FIG. 3 is a view illustrating a split cooler of FIG. 1.
Figure 4:
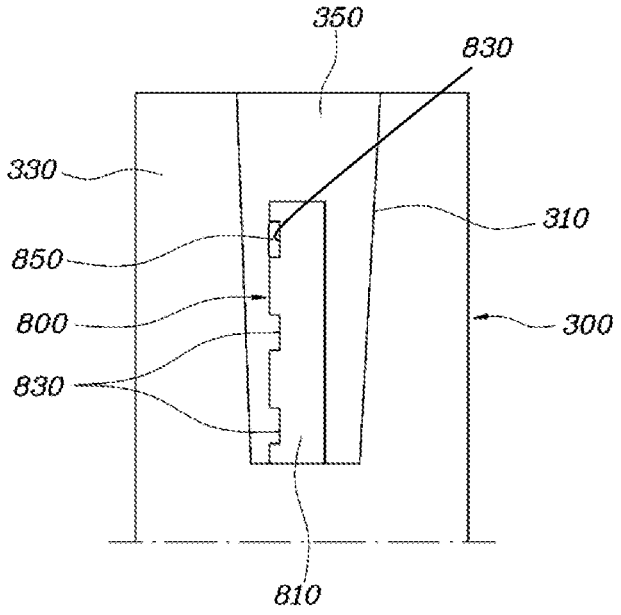
FIG. 4 and FIG. 5 are cross-sectional views illustrating that the split cooler is inserted into a water jacket.
Figure 5:
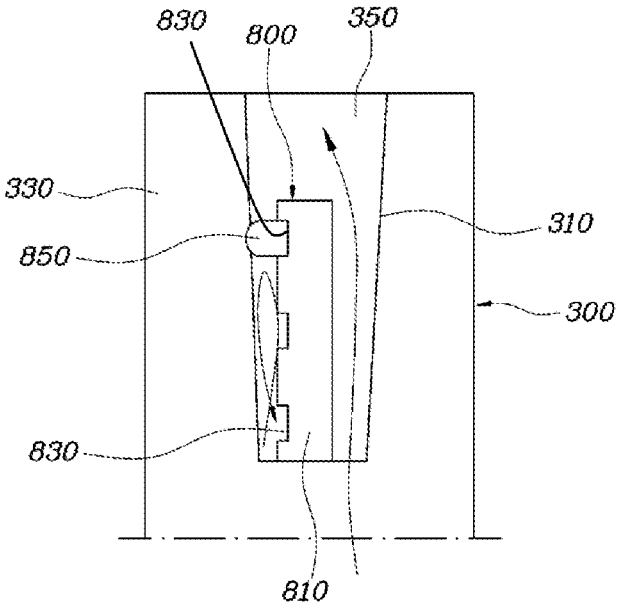
Figure 6:
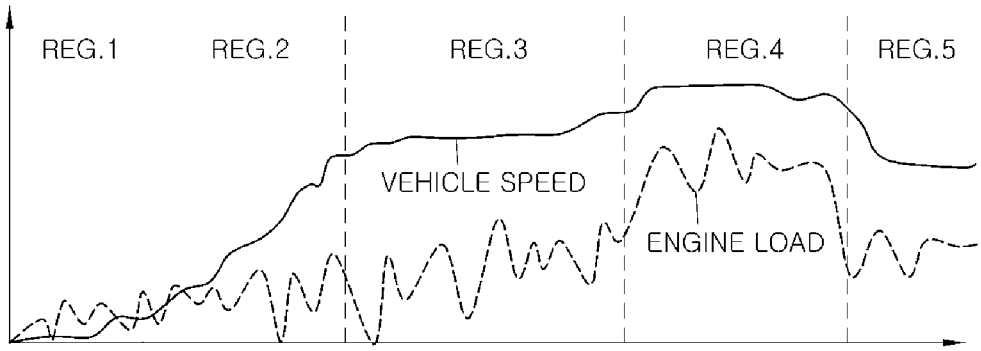
FIG. 6 Prior Art
FIG. 6, FIG. 7, and FIG. 8 are graphs illustrating the existing behavior of an engine.
Figure 7:
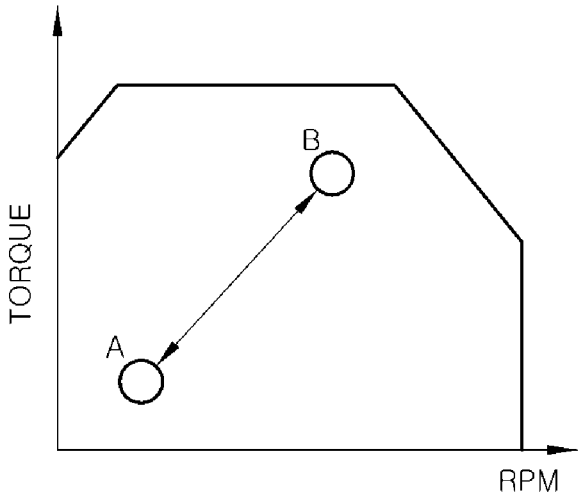
FIG. 7 Prior Art
Figure 8:
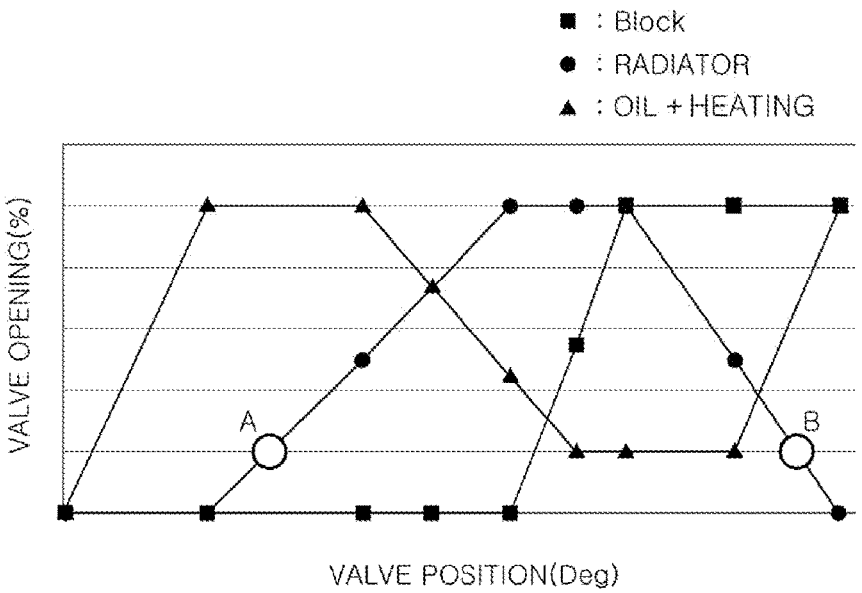
FIG. 8 Prior Art

FIG. 1 is a view illustrating a split cooling system of an internal combustion engine according to an exemplary embodiment of the present invention, FIG. 2 is a view illustrating an integrated flow control valve 400 of FIG. 1, and FIG. 3 is a view illustrating a split cooler 800 of FIG. 1. Further, FIG. 4 and FIG. 5 are cross-sectional views illustrating that the split cooler 800 is inserted into a water jacket 310.

The split cooling system of an internal combustion engine according to the exemplary embodiment of the present invention includes: a water pump 100 configured to circulate cooling water; a cylinder head 200 and a cylinder block 300 configured to be supplied with the cooling water from the water pump 100; an integrated flow control valve 400 configured to include an inlet 410 provided to be supplied with the cooling water of the cylinder head 200 and a plurality of valves 430, 450, and 470 that may be opened or closed to distribute the cooling water through the inlet 410 to an oil heat exchanger 500, a heater core 600, and a radiator 700; and a split cooler 800 configured to be mounted at the cylinder block 300 to provide a split cooling channel in the cylinder block 300 and the cylinder header 200. The plurality of valves 430, 450, and 470 of the integrated flow control valve 400 include a first valve 430 provided to supply the cooling water to the oil heat exchanger 500, a second valve 450 provided to supply the cooling water to the heater core 600, and a third valve 470 provided to supply the cooling water to the radiator 700.

The water pump 100 serves to provide the cooling water introduced from the oil heat exchanger 500, the heater core 600, and the radiator 700 to the cylinder head 200 and the cylinder block 300.

The integrated flow control valve 400 is a 3-port valve unit configured of the first valve 430, the second valve 450, and the third valve 470 and is supplied with the cooling water from the inlet 410 supplied with the cooling water from the cylinder head 200. The integrated flow control valve 400 includes at least one motor 490 to control an opening and closing of the first valve 430, the second valve 450, and the third valve 470. The first valve 430 is connected to the oil heat exchanger 500, the second valve 450 is connected to the heater core 600, and the third valve 470 is connected to the radiator 700. The content of the flow rate control of the cooling water among the water pump, the oil heat exchanger 500, the heater core 600, and the radiator 700 is already known, and therefore the detailed description thereof will be omitted.

The split cooler 800 is inserted into the water jacket 310 of the cylinder block 300 and includes a base 810 configured to enclose an outside of the cylinder 330 along a shape of the cylinder 330; a coupling groove 830 formed to be indented into an inside surface of the base 810; and a sealing member 850 configured to be filled in the coupling groove 830 and expanded when the temperature of the cooling water supplied into the water jacket 310 is equal to or higher than a preset temperature to cut off a channel between the base 810 and the cylinder 330, to thereby increase a flow resistance of the cooling water and reduce a heat transfer rate. The cylinder block 300 includes a moving channel 350 through which the cooling water of the cylinder block 300 moves to the cylinder head 200 and the cooling water of the cylinder block 300 moves to the cylinder head 200 and then is supplied to the integrated flow control valve 400 together with the cooling water of the cylinder head 200.

Describing in more detail it with reference to the drawing, as illustrated in FIG. 3, the base 810 may be integrally or monolithically formed in a shape to enclose an outside of the cylinder 330. The base 810 serves to divide the channel within the fluid jacket 310. Therefore, with respect to the base 810, the inside is a channel of the cylinder 330 side and an outside is a channel of an outside of the cylinder 330. Herein, the inside and an outside will be described as the inner and outer sides of the base 810. The cooling fluid of the cylinder block 300 may be supplied to the cylinder head 200 along the channel of an outside of the base 810 and the moving channel 350 may be formed at this point.

The base 810 is preferably formed from a lower side of the cylinder block 300 to a ⅔ point of a height of the cylinder block 300. There is a problem in that since the cylinder block 300 partially closes the cooling water channel when the conventionally typical split cooling is applied, the overall flow resistance of the cooling water is increased to reduce the whole flow rate of the cooling water. Therefore, the base 810 of the split cooler 800 is formed to enclose a ⅔ point from the lower side of the cylinder block 300 to prevent the problem from occurring and thus the whole of the water jacket 310 is not covered to minimize the increase in the whole flow resistance of the cooling water channel, thereby preventing the flow rate from being reduced. Therefore, compared to the existing split cooling structure, the efficiency of the heating performance and the cooling performance may be increased.

The coupling groove 830 is formed to be indented into the inside surface of the base 810. As illustrated in the drawing, the coupling groove 830 is formed along a horizontal direction of the base 810 and is preferably formed in a closed curve. The reason is that since the coupling groove 830 is filled with the sealing member 850 and the sealing member 850 cuts off the channel between the base 810 and the cylinder 330 to increase the flow resistance of the cooling water to reduce the heat transfer rate, when the sealing member 850 forms an opened curve, it is difficult to cut off the channel of the portion and thus it is difficult to effectively increase the flow resistance of the cooling water.

As illustrated in FIG. 4 and FIG. 5, the present exemplary embodiment illustrates and describes that the coupling groove 830 is formed over the base 810. However, only one coupling groove 830 may also be formed at a position where the sealing member 850 is applied. Further, the coupling groove 830 is formed in plural and thus the plurality of coupling grooves 830 may be positioned on the inside surface of the base 810 while being vertically spaced apart from each other at a predetermined interval. The number and positions of coupling grooves 830 may be differently applied to each car model and therefore the number and positions of coupling grooves may be changed as many as you want depending on the design or environment. As a result, the number and positions of coupling grooves are not specifically limited.

The coupling groove 830 is filled with the sealing member 850. The sealing member 850 may be ethylene propylene diene M-class (EPDM) rubber. The EPDM rubber is thermoplastic synthetic rubber in which ethylene, propylene, and diene are terpolymerized and is a structure without a butadiene component unlike general synthetic rubber. Therefore, the EPDM rubber has weather resistance and electric insulation more excellent than those of the general synthetic rubber.

Therefore, as illustrated in FIG. 4 and FIG. 5, the sealing member 850 has a tolerance occurring upon the assembling of the base 810 but is foamed when the temperature of the cooling water is equal to or higher than the preset temperature due to the filling of the cooling water to seal between the cylinder 330 and the base 810. That is, the sealing member 850 is foamed and then compressed to be foamed when the temperature of the cooling water is equal to or higher than the predetermined temperature and thus is filled in the coupling groove 830.

Therefore, when the split cooler 800 is assembled in the water jacket 310, the split cooler 800 is manufactured having a tolerance required for the assembling to be easily inserted and when the cooling water is filled in the water jacket 310 and thus the temperature of the cooling water rises to be equal to or higher than a preset temperature, the sealing member 850 is foamed to cut off the channel between the base 810 and the cylinder 330 to split the up and down flow of the cooling water and increase the flow resistance, reducing the heat transfer rate.

Therefore, the portion encapsulated by the cylinder 330, the sealing member 850, and the base 810 has a narrow gap and the increased flow resistance to reduce the heat transfer rate of a wall surface of the cylinder 330, thereby increasing the temperature of the surface of the cylinder 330. Since the flow resistance of the inside of the base 810 is increased, and therefore most of the cooling water moves to an outside of the base 810 and an upper side of the cylinder block 300, thereby implementing the split cooling.

Further, a siamese part 870 of the base 810 is provided with a guide member 890. The guide members 890 are preferably provided at each siamese part 870 of the base 810. The guide member 890 may be formed at a height corresponding to the height of the cylinder block 300. Further, the guide member 890 is a triangular prism and may be configured to be positioned in a shape in which a vertex thereof is inserted into the siamese part 870. Therefore, the flow of the cooling water of the upper portion of the cylinder block 300 is guided by the guide member 890 to increase the cooling effect and the assembling direction is set by the guide member 890, such that the assembling may be facilitated and the upper and lower positions may be fixed.

The split cooler 800 as described above is mounted at the cylinder block 300, and thus only the three ports of the integrated flow control valve 400 may be used to perform the sufficient flow rate control and the split cooling may be effectively performed within the cylinder block 300 and the cylinder head 200. Therefore, the existing integrated flow control valve repeats the high load and the low load in the internal combustion engine to which the variable split cooling port is applied to repeat the application/release of the split cooling upon the operation, thereby solving the instability of the temperature of the cooling water occurring due to the excessive operation of the valve.

Therefore, according to the split cooling system of an internal combustion engine of the present invention, the port taking charge of the variable split cooling is removed and only three ports are thus configured in the existing integrated flow control valve 400, and the split cooler 800 is mounted at the cylinder block 300 to increase the oil temperature in the cylinder block 300, obtaining the split cooling effect continuously. Further, one port for implementing the split cooling may be removed, such that the package may be simplified and the weight and costs may be saved. As the variable split cooling control port is not configured in the integrated flow valve, it is possible to solve the control instability of the temperature of the cooling water due to the port control.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A split cooling system of an internal combustion engine, comprising:

a water pump configured to circulate cooling water;

a cylinder head and a cylinder block configured to be supplied with the cooling water from the water pump;

an integrated flow control valve configured to include an inlet provided to be supplied with the cooling water of the cylinder head and a plurality of valves that are configured to be opened or closed to distribute the cooling water introduced through the inlet to an oil heat exchanger, a heater core, and a radiator; and a split cooler configured to be mounted at the cylinder block to provide a split cooling channel in the cylinder block and the cylinder header, wherein the split cooler is inserted into a water jacket of the cylinder block and includes:

a base configured to enclose an outside surface of a cylinder along a shape of the cylinder, wherein the base divides a channel within the water jacket into an inside channel and an outside channel, wherein the inside channel facing the outside surface of the cylinder is at an inside of the base and the outside channel facing the water jacket is at an outside of the base wherein the inside channel is disposed inward the base and the outside channel is disposed outward the base in a radial direction of the cylinder, and wherein an upper side of the base in the cylinder block continuously fluid-communicates with the outside channel;

a coupling groove formed to be indented into an inside surface of the base, wherein the inside surface of the base faces the outside surface of the cylinder; and a sealing member configured to be filled in the coupling groove wherein the sealing member selectively cuts off the inside channel according to a temperature of the cooling water, the sealing member being expanded when the temperature of the cooling water supplied into the water jacket is equal to or higher than a preset temperature to cut off the inside channel between the base and the cylinder, to increase a flow resistance of the cooling water and reduce a heat transfer rate, and wherein when the inside channel is cut off by the sealing member, a portion of the cooling water flows to the outside channel and surround a full length of the base from a bottom to a top.

2. The split cooling system of claim 1, wherein the base is formed from a lower side of the cylinder block to a ⅔ point of a height of the cylinder block.

3. The split cooling system of claim 1, wherein the coupling groove is formed along a horizontal direction of the base and is formed in a closed curve.

4. The split cooling system of claim 1, wherein the sealing member is ethylene propylene diene M-class (EPDM) rubber and is foamed and then compressed to be foamed when the cooling water is equal to or more than the preset temperature.

5. The split cooling system of claim 1, wherein siamese parts of the base are provided with a plurality of guide members.

6. The split cooling system of claim 1, wherein the cylinder block includes a moving channel through which the cooling water of the cylinder block moves to the cylinder head and the cooling water of the cylinder block moves to the cylinder head and then is supplied to the integrated flow control valve together with the cooling water of the cylinder head.

7. The split cooling system of claim 1, wherein the integrated flow control valve includes at least one motor to control an opening and closing of a first valve, a second valve, and a third valve.

8. The split cooling system of claim 1, wherein the plurality of valves of the integrated flow control valve include a first valve provided to supply the cooling water to the oil heat exchanger, a second valve provided to supply the cooling water to the heater core, and a third valve provided to supply the cooling water to the radiator.

* * * * *